US005716774A

United States Patent [19]

Dickerson et al.

[11] Patent Number: 5,716,774

[45] Date of Patent: Feb. 10, 1998

[54] RADIOGRAPHIC ELEMENTS CONTAINING ULTRATHIN TABULAR GRAIN EMULSIONS

[75] Inventors: Robert Edward Dickerson, Hamlin; Allen Keh-Chang Tsaur, Rochester, both of N.Y.

[73] Assignee: Eastman Kodak Company, Rochester, N.Y.

[21] Appl. No.: 724,722

[22] Filed: Sep. 30, 1996

[51] Int. Cl.[6] ..... G03C 1/46; G03C 5/16

[52] U.S. Cl. ..... 430/571; 430/502; 430/503; 430/966

[58] Field of Search ..... 430/503, 502, 430/966, 571

[56] References Cited

U.S. PATENT DOCUMENTS

| | | | |
|---|---|---|---|
| 3,923,515 | 12/1975 | Van Stappen . | |
| 4,425,425 | 1/1984 | Abbott et al. | 430/502 |
| 4,425,426 | 1/1984 | Abbott et al. | 430/502 |
| 5,041,364 | 8/1991 | Dickerson et al. | 430/502 |
| 5,108,881 | 4/1992 | Dickerson et al. | 430/502 |
| 5,217,858 | 6/1993 | Maskasky | 430/567 |
| 5,250,403 | 10/1993 | Antoniades et al. | 430/505 |
| 5,252,442 | 10/1993 | Dickerson et al. | 430/502 |
| 5,252,443 | 10/1993 | Dickerson et al. | 430/502 |
| 5,259,016 | 11/1993 | Dickerson et al. | 378/186 |
| 5,292,631 | 3/1994 | Hershey et al. | 430/567 |
| 5,370,977 | 12/1994 | Zietlow | 430/502 |
| 5,389,509 | 2/1995 | Maskasky | 430/567 |
| 5,391,464 | 2/1995 | Dickerson | 430/506 |
| 5,399,470 | 3/1995 | Dickerson et al. | 430/509 |
| 5,411,851 | 5/1995 | Maskasky | 430/569 |
| 5,411,853 | 5/1995 | Maskasky | 430/569 |
| 5,418,125 | 5/1995 | Maskasky | 430/569 |
| 5,460,934 | 10/1995 | Delton | 430/567 |
| 5,470,700 | 11/1995 | Marui | 430/567 |
| 5,494,789 | 2/1996 | Daubendiek et al. | 430/567 |
| 5,503,970 | 4/1996 | Olm et al. | 430/567 |
| 5,503,971 | 4/1996 | Daubendiek et al. | 430/567 |

*Primary Examiner*—Thorl Chea
*Attorney, Agent, or Firm*—Carl O. Thomas

[57] ABSTRACT

A radiographic element is disclosed in which from 10 to 60 percent of total silver forming the spectral sensitized silver halide grains is provided by one or more ultrathin tabular grain emulsions. It has been discovered that by limiting the proportions of ultrathin tabular grains desirably cold image tones can be obtained while improving other performance characteristics, including achieving significant reductions in crossover.

9 Claims, No Drawings

RADIOGRAPHIC ELEMENTS CONTAINING ULTRATHIN TABULAR GRAIN EMULSIONS

FIELD OF THE INVENTION

The invention relates to radiographic elements containing radiation-sensitive silver halide emulsions adapted to be exposed by a pair of intensifying screens.

DEFINITION OF TERMS

The term "equivalent circular diameter" or "ECD" is employed to indicate the diameter of a circle having the same projected area as a silver halide grain.

The term "coefficient of variation" or "COV" is defined as 100 times the standard deviation of grain ECD divided by mean ECD and is expressed as a percentage.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "ultrathin" in referring to tabular grains and tabular grain emulsions indicates that the tabular grains have a mean thickness of less than 0.07 μm.

The terms "high bromide" and "high chloride" in referring to grains and emulsions indicates that bromide or chloride, respectively, is present in concentrations of greater than 50 mole percent, based on total silver.

In referring to grains and emulsions containing two or more halides, the halides are named in order of ascending concentrations.

The term "dual-coated" in referring to radiographic elements indicates that image forming layer units are coated on both major faces of the support.

The term "crossover" refers to the exposure of an image forming layer unit on one side of a support in a dual-coated radiographic element by an intensifying screen on the opposite side of the support. Percent crossover is measured as described by Abbott et al U.S. Pat. No. 4,425,425, the disclosure of which is here incorporated by reference.

The term "cold" in referring to image tone is used to mean an image tone that has a CIELAB b* value measured at a density of 1.0 above minimum density that is −6.5 or more negative. Measurement technique is described by Billmeyer and Saltzman, Principles of Color Technology, 2nd Ed., Wiley, New York, 1981, at Chapter 3. The b* values describe the yellowness vs. blueness of an image with more positive values indicating a tendency toward greater yellowness.

The term "substantially optimally" in referring to sensitization is employed as defined Kofron et al U.S. Pat. No. 4,439,520, the disclosure of which is here incorporated by reference.

The term "covering power" is defined as the ratio of maximum density to developed silver.

*Research Disclosure* is published by Kenneth Mason Publications, Ltd., Dudley House, 12 North St., Emsworth, Hampshire P010 7DQ, England.

BACKGROUND

Abbott et al U.S. Pat. Nos. 4,425,425 and 4,425,426 report the first use of spectrally sensitized tabular grain emulsions in dual-coated radiographic elements. The emulsions were observed to reduce crossover. Abbott et al '425 teaches to use high (>8) aspect ratio tabular grain emulsions in which the tabular grains accounting for >50% of total grain projected area have a thickness of <0.30 μm. Abbott et al '426 teaches to use intermediate (5–8) aspect ratio tabular grain emulsions in which the tabular grains accounting for >50% of total grain projected area have a thickness of <0.20 μm. Neither Abbott et al '425 nor '426 reports any investigation of ultrathin (<0.07 μm) tabular grain emulsions.

Dual-coated radiographic elements are employed primarily for medical diagnostic imaging. For this application a cold image tone (defined quantitatively above) is believed by radiologists to facilitate more accurate diagnostic observations of recorded images. In qualitative terms a cold image tone is a neutral black or a black that is shifted toward the blue while a warm image tone occurs when the black image contains a noticeable brown component.

As the Abbott et al inventions were incorporated in dual-coated radiographic elements it became apparent that dual-coated radiographic elements containing tabular grain emulsions in some instances provide undesirably warm image tones. Subsequent investigations have correlated warm image tones in tabular grain emulsions to the thickness of the tabular grains. As the grains become progressively thinner, the images they produce become progressively warmer.

Based on these observations the art has generally avoided the use of tabular grain emulsions having grain thicknesses of less than 0.1 μm in dual-coated radiographic elements. For example, each of Dickerson et al U.S. Pat. Nos. 5,041,364, 5,108,881, 5,259,016 and 5,399,470 and Dickerson 5,252,443 provide examples of dual-coated radiographic elements in which the tabular grains have mean thicknesses >0.1 μm.

Dickerson et al U.S. Pat. No. 5,252,442 discloses tabular grain emulsions for use in dual-coated radiographic elements having thicknesses in the range of from 0.08 to 0.3 μm.

Hershey et al U.S. Pat. No. 5,292,631 discloses azole covering power enhancers for tabular grain emulsions useful in radiographic elements generally, including dual-coated radiographic elements. Emulsions A and B in Example 3 are ultrathin tabular grain emulsions. The radiographic elements in Example 3 are not dual-coated.

While ultrathin tabular grain emulsions have been generally avoided in the construction of dual-coated radiographic elements, significant performance advantages for these emulsions have been observed for photographic applications. The following are illustrative of ultrathin tabular grain emulsions taught for use in photographic imaging: Maskasky U.S. Pat. No. 5,217,858; Antoniades et al U.S. Pat. No. 5,250,403; Maskasky U.S. Pat. No. 5,389,509; Delton U.S. Pat. No. 5,460,934; Maskasky U.S. Pat. No. 5,411,851; Maskasky U.S. Pat. No. 5,411,853; Maskasky U.S. Pat. No. 5,418,125; Daubendiek et al U.S. Pat. No. 5,494,789; Olm et al U.S. Pat. No. 5,503,970; and Daubendiek et al U.S. Pat. No. 5,503,971.

SUMMARY OF THE INVENTION

In one aspect this invention is directed to a radiographic element comprised of a transparent film support having first and second major surfaces and, coated on each of the major surfaces, processing solution permeable hydrophilic colloid layers including at least two spectrally sensitized silver halide emulsions, wherein one of the spectrally sensitized silver halide emulsions is a tabular grain emulsion having a mean tabular grain thickness in the range of from 0.1 to 0.3 μm and a second of the spectrally sensitized silver halide emulsions is a tabular grain emulsion having a mean tabular grain thickness of less than 0.07 μm and accounting for from 10 to 60 percent of the total silver forming said spectrally sensitized tabular grain emulsions.

It has been discovered quite unexpectedly that combinations of (1) ultrathin tabular grain emulsions and (2) tabular grain emulsions having 0.1 to 0.3 μm mean tabular grain thicknesses, are capable of improving the performance of dual-coated radiographic elements while still providing acceptably cold image tones. Since the image tones of coatings containing only the ultrathin tabular grain emulsion are quite warm, the ability to obtain cold image tones in a blend containing a significant proportion of ultrathin tabular grains was entirely unexpected.

DESCRIPTION OF PREFERRED EMBODIMENTS

An exposure assembly, including a dual-coated radiographic element satisfying the requirements of the invention, is schematically illustrated as follows:

| |
|---|
| Front Screen Support (FSS) |
| Front Luminescent Layer (FLL) |

| |
|---|
| Front Hydrophilic Colloid Layer Unit (FHCLU) |
| Transparent Film Support (TFS) |
| Back Hydrophilic Colloid Layer Unit (BHCLU) |

| |
|---|
| Back Luminescent Layer (BLL) |
| Back Screen Support (BSS) |

Assembly I

A dual-coated radiographic element satisfying the requirements of the invention is formed by FHCLU, TFS and BHCLU. Prior to imagewise exposure to X-radiation, the dual-coated radiographic element, a front intensifying screen, formed by FSS and FLL, and a back intensifying screen, formed by BSS and BLL, are mounted in the orientation shown in a cassette (not shown), but with the screens and film in direct contact.

X-radiation in an image pattern passes through FSS and is, in part, absorbed in FLL. The front luminescent layer re-emits a portion of the absorbed X-radiation energy in the form of a light image, which exposes one or more silver halide emulsion layers contained in FHCLU. X-radiation that is not absorbed by the front screen passes through the dual-coated radiographic element with minimal absorption to reach BLL in the back screen. BLL absorbs a substantial portion of the X-radiation received and re-emits a portion of the X-radiation energy in the form of a light image that exposes one or more silver halide emulsion layers contained in BHCLU.

The light exposures described above are those desired to form a useful image in the dual-coated radiographic element. To the extent that light emitted by the front screen passes through FHCLU and TFS to expose BHCLU and light emitted by the back screen passes through BHCLU and TFS to expose FHCLU, image sharpness is degraded. These unwanted, sharpness degrading exposures of the dual-coated radiographic element are referred to as crossover. The use of spectrally sensitized tabular grain emulsions is recognized to reduce crossover.

In the dual-coated radiographic elements of the invention at least two spectrally sensitized tabular grain emulsions are present in each of FHCLU and BHCLU. One of the emulsions is a tabular grain emulsion having a mean tabular grain thickness in the range of from 0.1 to 0.3 (preferably 0.1 to 0.2) μm, hereinafter referred to as a 0.1–0.3 tabular grain emulsion. The second emulsion is an ultrathin tabular grain emulsion—that is, the mean thickness of its tabular grains is less than 0.07 μm.

Ultrathin tabular grain emulsions have several advantages over 0.1–0.3 tabular grain emulsions. At comparable silver coating coverages they provide a higher signal to noise ratio—i.e., higher image quality. They also have the capability of more rapid processing (e.g., development and, particularly, fixing). Since they provide higher covering power, coating coverages can be reduced using ultrathin tabular grain emulsions to obtain a selected maximum density. This in turn allows even further reductions in processing times.

What has, prior to this invention, proven to be a prohibitive commercial disadvantage of ultrathin tabular grain emulsions for use in medical diagnostic imaging is the warm image tones that they produce. Quantitatively, the b* values of a radiographic image at a density of 1.0 must be more negative than −6.5 to satisfy the cold image tone requirements of radiologists. As shown in the Examples below, ultrathin tabular grain emulsions, used alone, have b* values that are significantly less negative and, hence, unacceptably warm.

It has been discovered that when the combination of from 90 to 40 (preferably 80 to 50) percent of a spectrally sensitized 0.1–0.3 tabular grain emulsion is present in combination with from 10 to 60 (preferably 20 to 50) percent of a spectrally sensitized ultrathin tabular grain emulsion, acceptably cold image tones can be realized while realizing additional advantages attributable to the presence of the substantial proportions of ultrathin tabular grains. The percentages above are based on the total silver forming the two emulsions.

In the simplest structure possible satisfying the requirements of the invention, each of FHCLU and BHCLU can consist of a single spectrally sensitized radiation-sensitive emulsion layer prepared by blending a 0.1–0.3 tabular grain and an ultrathin tabular grain emulsions in the proportions described above. This arrangement is illustrated by the following:

| |
|---|
| Blended Tabular Grain Emulsion Layer (BTGREL) |
| Transparent Film Support (TFS) |
| Blended Tabular Grain Emulsion Layer (BTGREL) |

Element I

In actual implementation, it is preferred to modify Element I as follows:

| |
|---|
| Protective Layer Unit (PLU) |
| Blended Tabular Grain Emulsion Layer (BTGREL) |
| Underlying Layer Unit (ULU) |
| Transparent Film Support (TFS) |
| Underlying Layer Unit (ULU) |
| Blended Tabular Grain Emulsion Layer (BTGREL) |
| Protective Layer Unit (PLU) |

Element II

Although, for ease of description, each of the 0.1–0.3 tabular grain emulsion and the ultrathin thin emulsion are described as a single emulsion, it is recognized that either or both of these emulsions can, if desired, be formed by blending. The 0.1–0.3 tabular grain emulsion can be formed by blending two or more 0.1–0.3 tabular grain emulsions (usually emulsions differing in mean grain ECD and speed) and the ultrathin tabular grain emulsion can be formed by blending two or more ultrathin tabular grain emulsions (usually emulsions differing in mean grain ECD and speed).

For most imaging applications superior performance is realized by coating the 0.1–0.3 tabular grain emulsion and the ultrathin tabular grain emulsion in separate layers. Thus, the following elements are also contemplated:

| |
|---|
| Outer Tabular Grain Emulsion Layer (OTGREL) |
| Inner Tabular Grain Emulsion Layer (ITGREL) |
| Transparent Film Support (TFS) |
| Inner Tabular Grain Emulsion Layer (ITGREL) |
| Outer Tabular Grain Emulsion Layer (OTGREL) |

Element IV and

| |
|---|
| Protective Layer Unit (PLU) |
| Outer Tabular Grain Emulsion Layer (OTGREL) |
| Inner Tabular Grain Emulsion Layer (ITGREL) |
| Underlying Layer Unit (ULU) |
| Transparent Film Support (TFS) |
| Underlying Layer Unit (ULU) |
| Inner Tabular Grain Emulsion Layer (ITGREL) |
| Outer Tabular Grain Emulsion Layer (OTGREL) |
| Protective Layer Unit (PLU) |

Element V

When the higher speed emulsion is coated in OTGREL and the slower speed is coated in ITGREL, higher speeds are realized than when the emulsions are blended. In one form of the invention it is specifically contemplated to coat the ultrathin tabular grain emulsion in ITGREL. Placement of the ultrathin tabular grains in ITGREL disproportionately enhances the probability of light capture by the 0.1–0.3 tabular grain emulsion and provides a larger speed increase than is normally achieved by splitting the faster and slower emulsions between inner and outer emulsion layers. Additionally placement of the ultrathin tabular grain emulsion in ITGREL results in lower crossover and superior overall performance when both speed and crossover are taken into account. Since tabular grains increase in thickness as they are being grown in ECD, it simplifies manufacture to employ the ultrathin tabular grain emulsion as the slower (lower mean ECD) emulsion.

For some applications it is desired to increase image contrast. Coating the slower emulsion in OTGREL and the faster emulsion in ITGREL produces higher image contrast than when the same emulsions are blended. To increase contrast it is possible to locate the ultrathin tabular grain emulsion in OTGREL and the 0.1–0.3 tabular grain emulsion in ITGREL.

Alternatively and preferably, to increase contrast while retaining the advantages noted above for coating the ultrathin tabular grain emulsion in ITGREL, it is specifically contemplated to minimize the dispersity of the tabular grains. Under comparable conditions relatively monodisperse tabular grain emulsions produce higher contrasts than relatively polydisperse emulsions. In quantitative terms, it is preferred to reduce to less than 25 (preferably <15 and optimally <10) percent the coefficient of variation (COV) mean grain size for one or both of the 0.1–0.3 tabular grain and the ultrathin tabular grain emulsions.

Whereas dual-coated radiographic elements containing substantially optimally spectrally sensitized non-tabular grain emulsions without crossover reducing modifications ordinarily exhibit crossover levels in excess of above 30 percent, the substitution of substantially optimally spectrally sensitized 0.1–0.3 tabular grain emulsions are capable of significantly reducing crossover. Depending on exact formulations, crossover can be reduced below 20 percent. To reduce crossover below 10 percent it is conventional practice to employ a crossover reducing dye in combination with substantially optimally sensitized tabular grain emulsions in dual-coated radiographic elements. When a crossover reducing dye is incorporated in an emulsion layer, it competes with radiation-sensitive silver halide grains and hence reduces photographic speed. When the crossover reducing dye is kept out of the emulsion layer, as by coating the dye in a particulate form in ULU, the speed loss attributable to the dye is reduced, but the disadvantage is encountered of adding hydrophilic colloid to the element to form ULU, which reduces the rate at which the radiographic element can be processed.

As demonstrated in the Examples below, the ultrathin tabular grain emulsion when substantially optimally spectrally sensitized is capable of reducing crossover well below 20 percent in the proportions that are maintained to retain a cold image tone. Thus, it is specifically contemplated to construct dual-coated radiographic elements satisfying the requirements of the invention that contain no crossover reducing dye and suffer no speed loss attributable to competitive light absorption by crossover reducing dye. When the crossover reducing dye is eliminated, it is possible also to eliminate entirely the hydrophilic colloid layers ULU in Elements II and V. This in turn reduces the coating coverages of hydrophilic colloid that are incorporated. Reducing hydrophilic colloid coating coverages reduces the amount of water that is ingested during processing and reduces the drying load during processing, resulting in faster overall processing times.

As another alternative, it is recognized that the use of spectrally sensitized ultrathin tabular grain emulsions in combination with lower than conventional amounts of crossover reducing dyes can be employed to realize crossover levels of less than 10 percent. In one specifically contemplated form of the invention the crossover reducing dye limited to concentrations that produce an optical density of <1.00 (preferably <0.70) at the wavelength of exposure by the intensifying screens.

The 0.1–0.3 tabular grain emulsions can be selected from among the conventional tabular grain emulsions disclosed by the following U.S. patents, the disclosures of which are here incorporated by reference:

| | |
|---|---|
| Dickerson | U.S. Pat. No. 4,414,310; |
| Abbott et al | U.S. Pat. No. 4,425,425; |
| Abbott et al | U.S. Pat. No. 4,425,426; |
| Kofron et al | U.S. Pat. No. 4,439,520; |
| Wilgus et al | U.S. Pat. No. 4,434,226; |
| Maskasky | U.S. Pat. No. 4,435,501; |
| Wey | U.S. Pat. No. 4,399,215; |
| Maskasky | U.S. Pat. No. 4,400,463; |
| Wey et al | U.S. Pat. No. 4,414,306; |
| Mignot | U.S. Pat. No. 4,386,156; |
| Maskasky | U.S. Pat. No. 4,713,320; |
| Dickerson et al | U.S. Pat. No. 4,803,150; |
| Dickerson et al | U.S. Pat. No. 4,900,355; |
| Dickerson et al | U.S. Pat. No. 4,994,355; |
| Dickerson et al | U.S. Pat. No. 4,997,750; |
| Bunch et al | U.S. Pat. No. 5,021,327; |
| Tsaur et al | U.S. Pat. No. 5,147,771; |
| Tsaur et al | U.S. Pat. No. 5,147,772; |
| Tsaur et al | U.S. Pat. No. 5,147,773; |
| Tsaur et al | U.S. Pat. No. 5,171,659; |
| Maskasky et al | U.S. Pat. No. 5,176,992; |
| Maskasky | U.S. Pat. No. 5,178,997; |
| Maskasky | U.S. Pat. No. 5,183,732; |
| Maskasky | U.S. Pat. No. 5;185,239; |
| Dickerson et al | U.S. Pat. No. 5;252,442; |
| Maskasky | U.S. Pat. No. 5,264,337; |
| Maskasky | U.S. Pat. No. 5,275,930; |
| Maskasky | U.S. Pat. No. 5,292,632; |
| House et al | U.S. Pat. No. 5,320,930; |
| Dickerson | U.S. Pat. No. 5,391,469; |
| Maskasky | U.S. Pat. No. 5,399,478; |
| Maskasky | U.S. Pat. No. 5,411,852. |

The ultrathin tabular grain emulsions can be selected from among the conventional tabular grain emulsions disclosed by the following U.S. patents, the disclosures of which are here incorporated by reference:

| | |
|---|---|
| Maskasky | U.S. Pat. No. 5,217,858; |
| Antoniades et al | U.S. Pat. No. 5,250,403; |
| House et al | U.S. Pat. No. 5,320,930; |
| Maskasky | U.S. Pat. No. 5,389,509; |
| Delton | U.S. Pat. No. 5,460,934; |
| Maskasky | U.S. Pat. No. 5,411,851; |
| Maskasky | U.S. Pat. No. 5,411,853; |
| Maskasky | U.S. Pat. No. 5,418,125; |
| Daubendiek et al | U.S. Pat. No. 5,494,789; |
| Olm et al | U.S. Pat. No. 5,503,970; |
| Daubendiek et al | U.S. Pat. No. 5,503,971. |

The tabular grain emulsions from both patent lists above include those with {111} or {100} major faces. They include also high bromide or high chloride emulsions. In the interest of rapid access processing it is preferred to select the emulsions so that their iodide content is less than 4 mole percent, based on silver. For the highest attainable processing rates it is preferred to limit iodide to less than 1 mole percent, based on silver. Silver bromide and silver iodobromide emulsions are most commonly incorporated in dual-coated radiographic elements.

The mean ECD's of the tabular grain emulsions can take any convenient conventional value. Useful mean tabular grain ECD's range up to 10 μm, but are most commonly in the range of from about 0.5 to 5.0 μm. The ultrathin tabular grains are most conveniently formed with mean ECD's of up to about 3.0 μm.

It is preferred to employ thin (<0.2 μm mean tabular grain thickness) tabular grain emulsions in combination with the ultrathin tabular grain emulsions. The tabular grain emulsions are contemplated to include both intermediate (5–8) and high (>8) aspect ratio emulsions, with the latter being preferred.

Silver coating coverages are chosen to provide a maximum image density of at least 3.5, preferably at least 4.0.

Other conventional features of the tabular grain emulsion layers, including vehicle, hardener, antifoggants and stabilizers, and spectral sensitizing dye, are set out in the Dickerson, Dickerson et al and Bunch et al patents incorporated by reference above. As taught by Bunch et al and Dickerson et al, the dual-coated radiographic elements can be either symmetrically or asymmetrically coated by selecting the same or different emulsion layer units for coating on the opposite major faces of TFS.

The spectral sensitizing dye is chosen to match the wavelength of peak emission by the intensifying screens. Suitable spectral sensitizing dyes can be selected from among known categories of silver halide spectral sensitizing dyes, such as those illustrated by *Research Disclosure,* Vol. 389, September 1996, Item 38957, V. Spectral sensitization and desensitization, A. Sensitizing dyes.

TFS can be selected from conventional transparent radiographic film supports. Typically these supports consist of a transparent flexible film having subbing layer coated on its opposite major faces to improve adhesion by hydrophilic colloids. In many instances the surface coating on the transparent film support is itself a hydrophilic colloid layer, but highly hardened so that it is not processing solution permeable. Radiographic film supports usually exhibit the following distinguishing features: (1) the film support is constructed of polyesters to maximize dimensional integrity rather than employing cellulose acetate support as are most commonly employed in photographic elements and (2) the film supports are blue tinted to contribute toward the cold image tones desired, whereas photographic film supports are rarely, if ever, blue tinted. Radiographic film supports, including the incorporated blue dyes that contribute to cold image tones, are described in *Research Disclosure,* Vol. 184, April 1979, Item 18431, Section XII. *Research Disclosure,* Item 38957, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly(ethylene naphthalate) are specifically preferred polyester film supports.

The silver halide emulsion and other layers forming FHCLU and BHCLU, including PLU and ULU, where present, form processing solution permeable layer units on opposite sides of the support that contain conventional hydrophilic colloid vehicles (peptizers and binders), typically gelatin or a gelatin derivative. Conventional vehicles and related layer features are disclosed in *Research Disclosure,* Item 38957, II. Vehicles, vehicle extenders, vehicle-like addenda and vehicle related addenda. The emulsions themselves can contain peptizers of the type set out in II. above, paragraph A. Gelatin and hydrophilic colloid peptizers. The hydrophilic colloid peptizers are also useful as binders and hence are commonly present in much higher concentrations than required to perform the peptizing function alone. The vehicle extends also to materials that are not themselves useful as peptizers. Such materials are described in II. above, C. Other vehicle components.

The elements of the invention are fully forehardened to facilitate rapid access processing. The use of any convenient conventional hardener is contemplated. Such hardeners are described in II. above, B. Hardeners.

To facilitate rapid access processing it is contemplated to limit the vehicle coating coverages on each side of the support. To allow dry-to-dry processing in less than 90 seconds, each processing solution permeable layer unit must be fully forehardened and limited to a hydrophilic colloid coating coverage of less than 65 mg/dm$^2$, preferably less than 45 mg/dm$^2$. By fully forehardened it is meant that no additional hardening is required during processing.

The protective layer units PLU are typically provided for physical protection of the underlying emulsion layers. In addition to vehicle features discussed above the protective layer units can contain various addenda to modify the physical properties of the overcoats. Such addenda are illustrated by *Research Disclosure*, Item 38957, IX. Coating physical property modifying addenda, A. Coating aids, B. Plasticizers and lubricants, C. Antistats, and D. Matting agents. It is common practice to divide PLU into a surface overcoat and an interlayer. The interlayers are typically thin hydrophilic colloid layers that provide a separation between the emulsion or pelloid (particularly the former) and the surface overcoat addenda. It is quite common to locate surface overcoat addenda, particularly anti-matte particles, in the interlayers.

EXAMPLES

The following specific embodiments further illustrate the invention.

All coating coverages are reported parenthetically, ( ), in mg/dm$^2$, except as otherwise stated. Grain coating coverages are based on the weight of silver. Contrast was measured as the slope of a line drawn on the characteristic curve from a density of Dmin+0.25 to a density of Dmin+2.0. Speed was measured on the characteristic curve at Dmin+1.00. Speed is reported in relative log units—that is 100 units=1.00 log E, where E is exposure in lux-seconds.

$$HO-(CH\overset{CH_3}{\overset{|}{C}}H_2O)_x-(CH_2CH_2O)_y-(CH_2C\overset{CH_3}{\overset{|}{H}}O)_{x'}-H \quad (I)$$

Into a reaction vessel containing PLURONIC-31R1$^{TM}$, a surfactant satisfying formula I above, x=25, x'=25, y=7, at an amount equal to 36.3 wt % of silver subsequently introduced during nucleation, with good mixing was placed an aqueous gelatin solution (comprised of 1 liter of water, 10.0 g of oxidized bone gelatin, 4.17 mL of a 4N nitric acid solution, and 0.71 g of sodium bromide) and, while keeping the temperature thereof at 40° C. and a pAg of 9.41, 5.2 mL of an aqueous solution of silver nitrate (containing 4.42 g of silver nitrate) and 5.25 mL of an aqueous halide solution (containing 2.74 g of sodium bromide) were simultaneously added into the vessel over a period of 1 minute at a constant rate. Immediately afterwards, 3.25 mL of an aqueous halide solution (containing 1.70 g of sodium bromide) was added into the vessel at a constant rate over a period of 1.3 minutes. Thereafter, the temperature of the vessel was raised to 60° C. over a period of 12 minutes which was followed by a 9-minute hold in good mixing. Then, 6.67 mL of a 2.5N sodium hydroxide solution was added into the vessel over a period of 4 minutes. It was followed by the introduction of 178.1 mL of an aqueous silver nitrate solution (containing 151.3 g of silver nitrate) and 179.2 mL of an aqueous halide solution (containing 93.6 g of sodium bromide) at a constant rate over a period of 68.4 minutes.

Emulsion A thus made was a silver bromide ultrathin (111) tabular grain emulsion in which tabular grains accounted for >97% of total grain projected area. The mean ECD of the grains 0.96 μm, the mean thickness of the grains was 0.0669 μm, and the COV of the grains was 22.4%.

Thin Emulsions B–D

Three conventional silver bromide thin tabular grain emulsions of differing mean ECD's (and therefore differing speeds) were also prepared by double-jet precipitation.

TABLE I

| Thin Emulsion | Mean ECD (μm) |
|---|---|
| B | 2.69 |
| C | 1.95 |
| D | 1.27 |

The mean tabular grin thickness of each of thin tabular grain emulsions B through D was 0.13 μm.

EXAMPLES 1–4

Controls

Each of Emulsions A through D were sulfur and gold chemically sensitized and optimally spectrally sensitized employing anhydro-5,5'-dichloro-9-ethyl-3,3'-bis(3-sulfopropyl)oxacarbocyanine hydroxide, sodium salt and potassium iodide.

Each of the sensitized emulsions were then coated separately in the following format:

| | | |
|---|---|---|
| (4) | Overcoat gelatin | (3.55) |
| (3) | Interlayer gelatin | (3.55) |
| (2) | Emulsion | |
| | Grains | (12.92) |
| | Gelatin | (17.22) |
| (1) | Emulsion | |
| | Grains | (6.46) |
| | Gelatin | (6.46) |
| | Transparent Film Support (TFS) | |
| (1) | Emulsion | |
| | Grains | (6.46) |
| | Gelatin | (6.46) |
| (2) | Emulsion | |
| | Grains | (12.92) |
| | Gelatin | (17.22) |
| (3) | Interlayer gelatin | (3.55) |
| (4) | Overcoat gelatin | (3.55) |

Sensitometry

Exposures

Samples of the coated emulsions were exposed through a graduated density step tablet to a MacBeth sensitometer for 1/50th second to a 500 watt General Electric DMX projector lamp calibrated to 2650° K filtered with a Corning C4010 filter to simulate a green emitting X-ray screen exposure.

Processing

Processing of the exposed coatings was in each instance undertaken using a processor commercially available under the Kodak RP X-Omat™ film processor M6A-N. The processor employed the following processing cycle:

| | |
|---|---|
| Development | 24 seconds at 35° C. |
| Fixing | 20 seconds at 35° C. |
| Washing | 10 seconds at 35° C. |
| Drying | 20 seconds at 65° C. |

The developer employed exhibited the following formula, where all ingredient concentrations, except that of water, are reported in grams per liter:

| | |
|---|---|
| Hydroquinone | 30 |
| 4-Hydroxymethyl-4-methyl-1-phenyl-3-pyrazolidinone | 1.5 |
| Potassium hydroxide | 21 |
| Sodium bicarbonate | 7.5 |
| Potassium sulfite | 44.2 |
| Sodium sulfite | 12.6 |
| Sodium bromide | 35 |
| 5-Methylbenzotriazole | 0.06 |
| Glutaraldehyde | 4.9 |
| Water to 1 liter @ pH 10 | |

The properties of the individual emulsions are summarized in Table II.

TABLE II

| Emulsion | ECD/t (μm) | XO (%) | b* | Speed | Contrast |
|---|---|---|---|---|---|
| A | 0.96/0.069 | 12 | −3.8 | 405 | 3.4 |
| B | 2.69/0.13 | 24 | −7.3 | 465 | 3.0 |
| D | 1.95/0.13 | 24 | −7.5 | 440 | 2.8 |
| D | 1.27/0.13 | 24 | −7.4 | 409 | 2.6 |

XO = crossover b* values were measured at a density of 1.2 as reported in Hershey et al U.S. Pat. No. 5,292,631. The −3.8 b* value was substantially more positive than the −6.5 or more negative value required for an image tone sufficiently cold to meet medical diagnostic imaging requirements. By measuring b* values at a density of 1.2 rather than 1.0, the values were slightly warmer than if they had been measured at 1.0.

Crossover values achieved with the ultrathin tabular grain emulsion, Emulsion A, were only half of the crossover values realized using the thin tabular grain emulsions.

EXAMPLES 5–8

In this series of examples coating coverages were adjusted to maintain a constant maximum density of 3.5. Since the ultrathin tabular grain emulsion exhibited a higher covering power than the remaining emulsions, reductions in silver coating coverages were required.

EXAMPLE 5

Control

Examples 1–4 were repeated, except that Emulsions B and C were blended in equal proportions to form the (2) layers in the coating format and Emulsion D was employed in the (1) layers.

EXAMPLE 6

Example 5 was repeated, except that Emulsion A, reduced in silver coating coverage by one third, was substituted for Emulsion D.

EXAMPLE 7

Example 5 was repeated, except that Emulsion A replaced Emulsion D and the coating coverage of Emulsion C was decreased by half (50%).

EXAMPLE 8

Example 5 was repeated, except that Emulsion A, increased in silver coating coverage by one third, was substituted for Emulsion D and Emulsion C was omitted.

The coating coverages of the emulsions in Examples 5–8 are set out in Table III:

TABLE III

| Example | Layer (2) | Layer (1) |
|---|---|---|
| 5 (control) | B (6.46) + C (6.46) | D (6.46) |
| 6 | B (6.46) + C (6.46) | A (4.31) |
| 7 | B (6.46) + C (6.46) | A (6.46) |
| 8 | B (6.46) | A (8.62) |

The properties of the Examples, measured as reported in Table II, but with b* values measured at a density of 1.0, are reported below in Table III.

TABLE III

| Emulsion | Dmin | Dmax | XO (%) | b* | Speed | Contrast |
|---|---|---|---|---|---|---|
| 5 (Cont.) | 0.22 | 3.5 | 24 | −7.8 | 448 | 2.2 |
| 6 | 0.23 | 3.5 | 18 | −7.7 | 445 | 2.3 |
| 7 | 0.22 | 3.5 | 17 | −7.7 | 435 | 2.2 |
| 8 | 0.22 | 3.5 | 17 | −7.6 | 425 | 2.2 |

The addition of ultrathin tabular grain emulsions to the dual-coated radiographic elements of Examples 6–8 significantly reduced crossover, but with very limited impact on b* values at a density of 1.0. At a density of 0.5 the presence of the Example 5–8 elements exhibited b* values of −12.4 to −12.5. At higher (1.5–2.5) densities, b* values were relatively more positive than at a density of 1.0, and the ultrathin tabular grain emulsion concentrations had a greater impact on b* values. However, the eye is much less sensitive to image tone in the latter range and hence the relatively more positive b* values were not objectionable.

The lower speeds of the coatings containing higher proportions of ultrathin tabular grain emulsion was, of course, expected, since the ultrathin tabular grain emulsion exhibited a lower mean ECD than the remaining emulsions. The contrast invariance was made possible by the relatively low coefficient of variation of the ultrathin tabular grains.

The invention has been described in detail with particular reference to preferred embodiments thereof, but it will be understood that variations and modifications can be effected within the spirit and scope of the invention.

What is claimed is:

1. A radiographic element comprised of a transparent film support having first and second major surfaces and, coated on each of the major surfaces, processing solution permeable hydrophilic colloid layers including at least two spectrally sensitized silver halide emulsions, wherein one of said spectrally sensitized silver halide emulsions is a tabular grain emulsion having a mean tabular grain thickness in the range of from 0.1 to 0.3 μm and a second of said spectrally sensitized silver halide emulsions is a tabular grain emulsion having a mean grain tabular grain thickness of less than 0.07 μm and accounting for from 10 to 60 percent of the total silver forming said spectrally sensitized tabular grain emulsions.

2. A radiographic element according to claim 1 wherein the tabular grain emulsion having a mean grain thickness of less than 0.07 μm accounts for from 20 to 50 percent of the total silver forming said spectrally sensitized silver halide grains.

3. A radiographic element according to claim 1 wherein the tabular grain emulsion having a mean grain thickness of less than 0.07 μm has a coefficient of variation of grain equivalent circular diameter of less than 25 percent.

4. A radiographic element according to claim 1 wherein the tabular grain emulsion having a mean grain thickness of less than 0.07 μm and at least a portion of the tabular grain emulsion having a mean grain thickness in the range of from 0.1 to 0.3 μm are blended in at least one hydrophilic colloid layer coated on each of the major faces of the support.

5. A radiographic element according to claim 1 wherein on each major surface of the support said hydrophilic colloid layers form at least two separate emulsion layers and the tabular grain emulsion having a mean grain thickness of less than 0.07 μm is confined to one of said two emulsion layers.

6. A radiographic element according to claim 5 wherein on each major surface of the support the emulsion layer containing the tabular grain emulsion having a mean grain thickness of less than 0.07 μm is coated nearer the support than at least one other emulsion layer.

7. A radiographic element according to claim 6 wherein a particulate crossover reducing dye is present in the emulsion layer containing the tabular grain emulsion having a mean grain thickness of less than 0.07 μm.

8. A radiographic element according to claim 1 wherein one of said tabular grain emulsions has a mean grain thickness in the range of from 0.1 to 0.2 μm.

9. A radiographic element according to claim 1 wherein said tabular grain emulsions contain silver bromide and up to 4 mole percent iodide, based on silver.

* * * * *